US006057264A

United States Patent [19]

Bradbury

[11] Patent Number: 6,057,264

[45] Date of Patent: May 2, 2000

[54] DYE DIFFUSION THERMAL TRANSFER PRINTING

[75] Inventor: Roy Bradbury, St. Helens, United Kingdom

[73] Assignee: Imperial Chemical Industries PLC, London, United Kingdom

[21] Appl. No.: 08/913,984

[22] PCT Filed: Mar. 1, 1996

[86] PCT No.: PCT/GB96/00475

§ 371 Date: Dec. 3, 1997

§ 102(e) Date: Dec. 3, 1997

[87] PCT Pub. No.: WO96/30214

PCT Pub. Date: Oct. 3, 1996

[30] Foreign Application Priority Data

Mar. 25, 1995 [GB] United Kingdom ..... 9506117

[51] Int. Cl.[7] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | |
|---|---|---|
| Re. 34,737 | 9/1994 | Niwa et al. . |
| 5,145,828 | 9/1992 | Etzbach et al. . |

FOREIGN PATENT DOCUMENTS

| | | |
|---|---|---|
| 0 318 034 | 5/1989 | European Pat. Off. . |
| 0 442 360 | 8/1991 | European Pat. Off. . |
| 0 518 359 | 12/1992 | European Pat. Off. . |

*Primary Examiner*—Bruce H. Hess
*Attorney, Agent, or Firm*—Pillsbury Madison & Sutro LLP

[57] ABSTRACT

A thermal transfer sheet comprising a substrate having a coating comprising a substituted hindered indoline dye and a process for the use of such transfer sheets in dye diffusion thermal transfer printing.

5 Claims, No Drawings

DYE DIFFUSION THERMAL TRANSFER PRINTING

INTRODUCTION

This specification describes an invention relating to dye diffusion thermal transfer printing DDTTP or D2T2 printing, especially to a transfer sheet carrying a dye or a dye mixture, to a transfer printing process in which the dye or the dye mixture is transferred from the transfer sheet to a receiver sheet by the application of heat.

It is known to print woven or knitted textile material by a thermal transfer printing (TTP) process. In such a process a sublimable dye is applied to a paper substrate (usually as an ink also containing a resinous or polymeric binder to bind the dye to the substrate until it is required for printing) in the form of a pattern, to produce a transfer sheet comprising a paper substrate printed with a pattern which it is desired to transfer to the textile. Substantially all the dye is then transferred from the transfer sheet to the textile material, to form an identical pattern on the textile material, by placing the patterned side of the transfer sheet in contact with the textile material and heating the sandwich, under light pressure from a heated plate, to a temperature from 180–220° C. for a period of 30–120 seconds.

As the surface of the textile substrate is fibrous and uneven it will not be in contact with the printed pattern on the transfer sheet over the whole of the pattern area. It is therefore necessary for the dye to be sublimable and vaporise during passage from the transfer sheet to the textile substrate in order for dye to be transferred from the transfer sheet to the textile substrate over the whole of the pattern area.

As heat is applied evenly over the whole area of the sandwich over a sufficiently long period for equilibrium to be established, conditions are substantially isothermal, the process is non-selective and the dye penetrates deeply into the fibres of the textile material.

In DDTTP, a transfer sheet is formed by applying a heat-transferable dye (usually in the form of a solution or dispersion in a liquid also containing a polymeric or resinous binder to bind the dye to the substrate) to a thin (usually <20 micron) substrate having a smooth plain surface in the form of a continuous even film over the entire printing area of the transfer sheet. Dye is then selectively transferred from the transfer sheet by placing it in contact with a material having a smooth surface with an affinity for the dye, hereinafter called the receiver sheet, and selectively heating discrete areas of the reverse side of the transfer sheet for periods from about 1 to 20 milliseconds (msec) and temperatures up to 300° C., in accordance with a pattern information signal, whereby dye from the selectively heated regions of the transfer sheet diffuses from the transfer sheet into the receiver sheet and forms a pattern thereon in accordance with the pattern in which heat is applied to the transfer sheet. The shape of the pattern is determined by the number and location of the discrete areas which are subjected to heating and the depth of shade in any discrete area is determined by the period of time for which it is heated and the temperature reached.

Heating is generally, though not necessarily, effected by a line of heating elements, over which the receiver and transfer sheets are passed together. Each element is approximately square in overall shape, although the element may optionally be split down the centre, and may be resistively heated by an electrical current passed through it from adjacent circuitry. Each element normally corresponds to an element of image information and can be separately heated to 300° C. to 400° C., in less than 20 msec and preferably less than 10 msec, usually by an electric pulse in response to a pattern information signal. During the heating period the temperature of an element will rise to about 300–400° C. over about 5–8 msec. With increase in temperature and time more dye will diffuse from the transfer sheet to the receiver sheet and thus the amount of dye transferred onto, and the depth of shade at, any discrete area on the receiver sheet will depend on the period for which an element is heated while it is in contact with the reverse side of the transfer sheet.

As heat is applied through individually energised elements for very short periods of time the process is selective in terms of location and quantity of dye transferred and the transferred dye remains close to the surface of the receiver sheet.

As an alternative heating may be effected using a light source in a light-induced thermal transfer (LITT or L2T2 printing) printer where the light source can be focused, in response to an electronic pattern information signal, on each area of the transfer sheet to be heated. The heat for effecting transfer of the dye from the transfer sheet is generated in the dyesheet which has an absorber for the inducing light. The absorber is selected according to the light source used and converts the light to thermal energy, at a point at which the light is incident, sufficient to transfer the dye at that point to the corresponding position on the receiver sheet. The inducing light usually has a narrow waveband and may be in the visible, infra-red or ultra violet regions although infra-red emitting lasers are particularly suitable.

It is clear that there are significant distinctions between TTP onto synthetic textile materials and DDTTP onto smooth polymeric surfaces and thus dyes which are suitable for the former process are not necessarily suitable for the latter.

In DDTTP it is important that the surfaces of the transfer sheet and receiver sheet are even so that good contact can be achieved between the printed surface of the transfer sheet and the receiving surface of the receiver sheet over the entire printing area because it is believed that the dye is transferred substantially by diffusion in the molten state in condensed phases. Thus, any defect or speck of dust which prevents good contact over any part of the printing area will inhibit transfer and lead to an unprinted portion on the receiver sheet on the area where good contact is prevented, which can be considerably larger than the area of the speck or defect. The surfaces of the substrate of the transfer and receiver sheets are usually a smooth polymeric film, especially of a polyester, which has some affinity for the dye.

Important criteria in the selection of a dye for DDTTP are its thermal properties, fastness properties, such as light fastness, and facility for transfer by diffusion into the substrate in the DDTTP process. For suitable performance the dye or dye mixture should transfer evenly and rapidly, in proportion to the heat applied to the transfer sheet so that the amount transferred to the receiver sheet is proportional to the heat applied. After transfer the dye should preferably not migrate or crystallise and should have excellent fastness to light, heat, rubbing, especially rubbing with a oily or greasy object, e.g. a human finger, such as would be encountered in normal handling of the printed receiver sheet. As the dye should be sufficiently mobile to migrate from the transfer sheet to the receiver sheet at the temperatures employed, 100–400° C., in the short time-scale, generally <20 msec, it is preferably free from ionic and/or water-solubilising groups, and is thus not readily soluble in aqueous or watermiscible media, such as water and ethanol. Many potentially suitable dyes are also not readily soluble in the solvents which are commonly used in, and thus acceptable to, the printing industry; for example, alcohols such as i-propanol, ketones such as methyl ethyl ketone (MEK), methyl i-butyl ketone (MIBK) and cyclohexanone, ethers such as tetrahydrofuran and aromatic hydrocarbons such as toluene. The dye can be applied as a dispersion in a suitable medium or as a solution in a suitable solvent to the substrate from a solution. In order to achieve the potential for a high optical density (OD) on the receiver sheet it is desirable that the dye should be readily soluble or readily dispersable in the ink medium. It is also important that a dye which has been applied to a transfer sheet from a solution should be resistant to crystallisation so that it remains as an amorphous layer on the transfer sheet for a considerable time. Crystallisation not only produces defects which prevent good contact between the transfer receiver sheet but gives rise to uneven prints.

The following combination of properties is highly desirable for a dye which is to be used in DDTTP:

Ideal spectral characteristics (narrow absorption curve) and high extinction coefficient.

Correct thermochemical properties (high thermal stability and efficient transferability with heat).

High optical densities on printing.

Good solubility in solvents acceptable to printing industry: this is desirable to produce solution coated dyesheets alternatively good dispersibility in acceptable media is desirable to produce dispersion coated dyesheets.

Stable dyesheets (resistant to dye migration or crystallisation).

Stable printed images on the receiver sheet (resistant to heat, migration, crystallisation, grease, rubbing and light).

DDTTP is used for printing images on suitable substrates.

The achievement of good light fastness in DDTTP is extremely difficult because of the unfavourable environment of the dye, close to the surface of the polyester receiver sheet. Many known dyes for polyester fibre have high light fastness (>6 on the International Scale of 1–8) on polyester fibre when applied by TTP because dye penetration into the fibres is good, but the same dyes exhibit very poor light fastness on a polyester receiver sheet when applied by DDTTP because of poor penetration into the substrate.

According to the present invention there is provided a thermal transfer sheet comprising a substrate having a coating comprising a dye of Formula (1):

Formula (1)

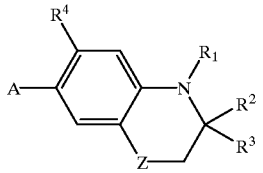

in which $R^1$ is alkyl, cycloalkyl, aryl, alkenyl or aralkyl each of which may be optionally substituted;

$R^2$ and $R^3$ each independently is optionally substituted alkyl;

$R^4$ is —H, —OH or alkyl, alkoxy, —NHCOalkyl, —NHCOaryl, —$NHSO_2$alkyl, —$NHSO_2$aryl each of which may be optionally substituted;

Z is a direct link, oxygen or —N—$R^5$ in which $R^5$ is —H, optionally substituted alkyl or optionally substituted aryl;

A is a group of Formula (2):

B—N=N— Formula (2)

in which B is an aryl or heterocyclic group each of which may be optionally substituted; or A is a group of Formula (3):

Formula (3)

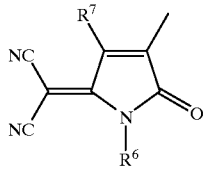

in which $R^6$ is —H or alkyl, alkenyl or aralkyl each of which may be optionally substituted, —$SO_2$alkyl, $SO_2$ aryl or —COR in which R is —H or alkyl, aryl, cycloalkyl or aralkyl each of which may be optionally substituted;

$R^7$ is an electron withdrawing group; or

A is an optionally substituted group of Formula (4):

Formula (4)

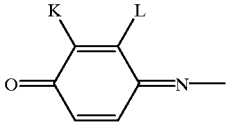

in which K and L are optional substituents or a form a 5- or 6-membered carbocyclic or heterocyclic ring with the carbon atoms to which they are attached; or A is a group of Formula (5):

Formula (5)

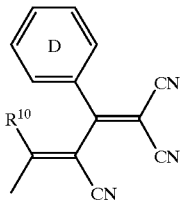

in which $R^{10}$ is —CH or N; and

Ring D may be optionally substituted by from 1 to 5 substituents; or

A is a group of Formula (6):

Formula (6)

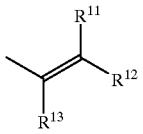

in which $R^{11}$ and $R^{12}$ each independently is an electron withdrawing group; and $R^{13}$ is —H or —CN; or A is a group of Formula (7):

Formula (7)

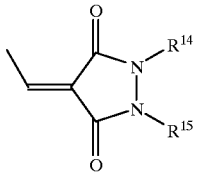

in which $R^{14}$ and $R^{15}$ is aryl; or

A is a group of Formula (8):

Formula (8)

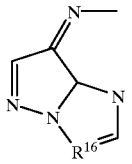

in which $R^{16}$ is N or C—R is as hereinbefore defined; or

A is a group of Formula (9):

Formula (9)

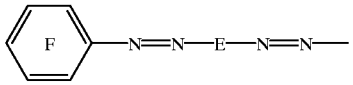

in which Ring F is optionally substituted by from 1 to 5 groups and E is carbocyclic or heterocyclic; or A is a group of Formula (10):

Formula (10)

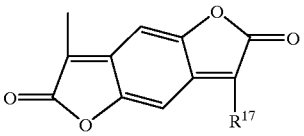

in which $R^{17}$ is optionally substituted aryl or a group of Formula (16B)

Formula (16b)

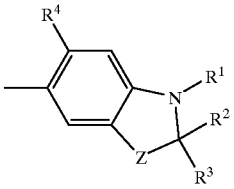

or A is a group of Formula (6B):

Formula (6B)

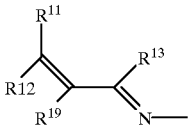

in which $R^{19}$ is $—NH_2$ or a group of Formula

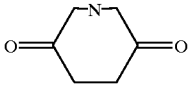

The alkyl group represented by R, $R^1$, $R^2$, $R^3$, $R^4$, $R^5$, $R^6$ is preferably $C_{1-20}$-alkyl, more preferably $C_{1-12}$-alkyl and especially $C_{1-8}$-alkyl.

The cycloalkyl group represented by R and $R^1$ is preferably $C_{4-8}$-cycloalkyl, more preferably cyclohexyl.

The aryl group represented by R, $R^1$, $R^5$, $R^{14}$, $R^{15}$, $R^{17}$ and Y is preferably phenyl or naphthyl, more preferably phenyl.

The alkenyl group represented by $R^1$ and $R^6$ is preferably $C_{2-10}$-alkenyl, more preferably $C_{2-6}$-alkenyl and especially $C_{2-3}$-alkenyl such as allyl or vinyl.

The aralkyl group represented by R, $R^1$ and $R^6$ is preferably aryl $C_{1-6}$-alkyl, more preferably phenyl $C_{1-6}$-alkyl, especially phenyl $C_{1-3}$-alkyl such as benzyl, phenylethyl, chlorobenzyl or nitrobenzyl.

Where $R^4$ is —NHCOalkyl it is preferably $—NHCOC_{1-6}$-alkyl, more preferably $—NHCOC_{1-4}$-alkyl and especially $—NHCOCH_3$ or $—NHCOC_2H_5$.

Where $R^4$ is alkoxy it is preferably $C_{1-12}$-alkoxy and more preferably $C_{1-8}$-alkoxy.

Where $R^6$ is $—SO_2$alkyl it is preferably $—SO_2C_{1-4}$-alkyl.

Where $R^6$ is $—SO_2$aryl it is preferably $—SO_2$phenyl.

Where $R^7$, $R^{11}$, $R^{12}$ are electron withdrawing groups they are preferably —CN, $—SO_2F$, $—COOR^8$, $—CONR^8R^8$, $—SO_2R^8$ in which $R^9$ and $R^9$ each independently is —H or any of the groups defined above for $R^1$.

Where B is an aryl group it is preferably phenyl or naphthyl, especially phenyl.

Where B is a heterocyclic group it is preferably thienyl, thiazolyl, isothiazolyl, pyridyl, pyrazolyl, thiadiazolyl, imidazolyl, oxazolyl, benzoisothiazolyl and more preferably thienyl, isothiazolyl, thiazolyl and pyrazolyl and especially thienyl, thiazolyl and isothiazolyl. B is preferably phenyl, thienyl, isothiazolyl, thiazolyl or pyrazolyl especially phenyl, thienyl, isothiazolyl or thiazolyl.

Where any of the groups represented by R, $R^1$ to $R^9$, $R^{17}$, B, Ring D, Ring F or the group of Formula (4) are optionally substituted the optional substituents may be selected from $—NO_2$, —CN, —OH, —Cl, —F, —Br, —SCN, phenyl, alkyl, alkoxy, alkylthio, alkoxyalkoxy, alkylcarbonyl, alkoxycarbonyl, alkylalkoxycarbonyl, alkoxyalkoxycarbonyl, alkoxycarbonyloxy, phenoxylalkyl, phenylalkyl, alkylcarbonyloxy, alkoxyalkoxycarbonyloxy, alkylcarbonyloxy, phenoxyalkoxycarbonyl, $—NR^8R^9$, $—COR^8$, $—CO_2R^8$ in which $R^8$ and $R^9$ are as hereinbefore defined, —NHCOalkyl and $—NHSO_2$alkyl in each of the above substituents each alkyl is preferably $C_{1-4}$-alkyl and each alkoxy is preferably $C_{1-4}$-alkoxy. Preferred substituents are $—NO_2$, —CN, $—CO_2R^8$, $C_{1-4}$alkyl, $C_{1-4}$-alkylthio —SCN, $—COR^8$, —Cl and —Br. K and L may be any of the optional substituents listed above.

The alkyl groups represented by R and $R^1$ to $R^6$, $R^8$ and $R^9$ and alkyl and alkoxy substituents listed above may be straight or branched chain alkyl or alkoxy groups.

Where E is carbocyclic it is preferably of Formula (17A) or (17B):

Formula (17A)

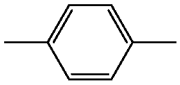

or

Formula (17B)

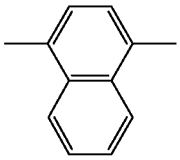

and may carry any of the optional substituents defined above. Where E is heterocyclic it is preferably of Formula (18):

Formula (18)

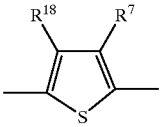

or of Formula (19):

Formula (19)

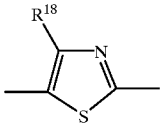

in which $R^7$ is as hereinbefore defined and $R^{18}$ is —H, $C_{1-4}$-alkyl, —F, —Cl or —Br.

A is preferably a group of Formula (2), Formula (3), Formula (4), Formula (5), Formula (6), Formula (6B), Formula (7), Formula (9) or Formula (10), more preferably a group of Formula (2) or Formula (4), and especially a group of Formula (2).

In dyes of Formula (1) $R^1$ is preferably $C_{1-8}$-alkyl, more preferably an α-branched $C_{3-8}$-alkyl or a straight chain $C_{1-8}$-alkyl and especially 1-methylhexyl, n-heptyl, n-butyl, isobutyl $R^2$ and $R^3$, are preferably $C_{1-8}$-alkyl, more preferably $C_{1-4}$-alkyl and especially methyl, $R^4$ is preferably —H, $C_{1-8}$-alkyl, —$NHCOC_{1-8}$-alkyl, —OH or $C_{1-8}$-alkoxy more preferably —H, $C_{1-4}$-alkyl or —$NHCOC_{1-4}$-alkyl and especially —H, methyl or —NHCOmethyl or —NHCOethyl.

A particularly preferred group of dyes Formula (1) are those in which $R^3$ and $R^3$ are both methyl.

A preferred sub-group of dyes of Formula (1) are those of Formula (11):

Formula (11)

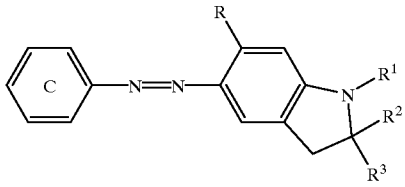

in which $R^1$, $R^2$, $R^3$ and $R^4$ are as hereinbefore defined; and Ring C carries from 1 to 5 optional substituents selected from those listed above. Ring C is preferably substituted by 1 to 3 substituents and these are preferably in the 2-, 4- or 6-positions. Especially preferred dyes of Formula (11) are those in which Ring C is substituted by one or more substituents selected from —$NO_2$, —CN, —$CH_3$, —Cl and —Br, $R^1$ is straight or branched chain $C_{1-8}$-alkyl, $R^2$ and $R^3$ are both —$CH_3$ and $R^4$ is —H.

A further preferred sub group of dyes of Formula (1) are those of Formula (12):

Formula (12)

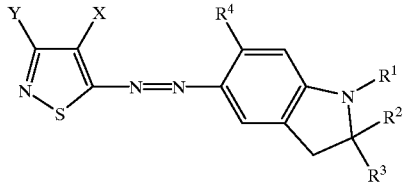

in which $R^1$, $R^2$, $R^3$ and $R^4$ are as hereinbefore defined;

X is —CN or halogen; and

Y is pyridyl or aryl or $C_{1-8}$-alkyl which is optionally substituted by $C_{1-4}$-alkoxy. Especially preferred dyes of Formula (12) are those in which Y is phenyl or —$CH_3$, X is —CN, $R^1$ is straight or branched chain $C_{1-8}$-alkyl, $R^2$ and $R^3$ are both —$CH_3$ and $R^4$ is —H.

A further preferred sub group of Formula (1) are those of Formula (12A):

Formula (12A)

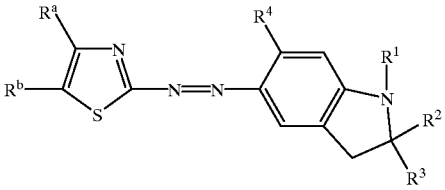

in which $R^1$, $R^2$, $R^3$ and $R^4$ are as hereinbefore defined;

$R^a$ is —H or $C_{1-4}$-alkoxy; and $R^b$ is —H, —$NO_2$ or formyl.

Especially preferred dyes of Formula (12A) are those in which $R^a$ is —H or $CH_3O$—, $R^b$ is —$NO_2$ or formyl, $R^1$ is straight or branched chain $C_{1-8}$-alkyl, $R^2$ and $R^3$ are both —$CH_3$ and $R^4$ is —H.

A further preferred sub group of dyes of Formula (1) are those of Formula (12B):

Formula (12B)

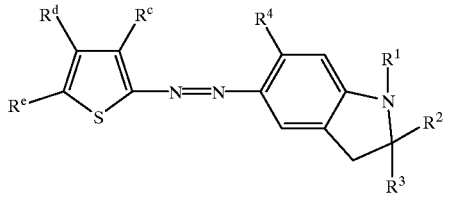

in which $R^1$, $R^2$, $R^3$ and $R^4$ are as hereinbefore defined;

$R^c$ is —H, —CN, —$NO_2$, formul or —$COOC_{1-4}$alkyl;

$R^d$ is —H, —Cl or $C_{1-4}$-alkyl; and $R^e$ is —H, —$NO_2$, —CN, formyl, —C═C$(CN)_2$ or —C═C(CN)$CO_2C_{1-4}$-alkyl.

Especially preferred dyes of Formula (12B) are those in which $R^c$ is —CN, —$NO_2$, formyl or —$COOC_2H_5$, $R^d$ is —H, —Cl or —$CH_3$, $R^e$ is —$NO_2$, —CN, formyl, —C═C$(CN)_2$ or —C═C(CN)$CO_2C_2H_5$, $R^1$ is straight or branched chain $C_{1-8}$-alkyl, $R^2$ and $R^3$ are both —$CH_3$ and $R^4$ is —H.

A further preferred sub group of dyes of Formula (1) are those of Formula (12C):

Formula (12C)

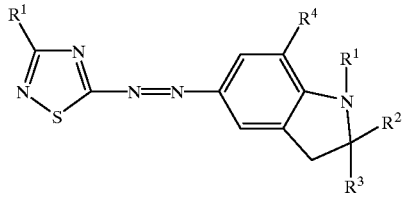

in which $R^1$, $R^2$, $R^3$ and $R^4$ are as hereinbefore defined;

$R^f$ is —H or —$SC_{1-4}$aklyl.

Especially preferred dyes of Formula (12C) are those in which $R^f$ is —$SCH_3$, $R^1$ is straight or branched chain $C_{1-8}$-alkyl, $R^2$ and $R^3$ are both —$CH_3$ and $R^4$ is —H.

A further preferred sub group of dyes of Formula (1) are those of Formula (12D):

Formula (12D)

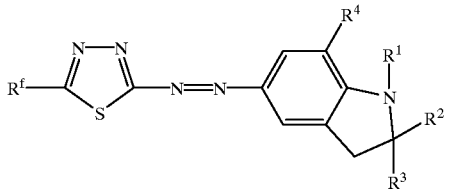

in which $R^1$, $R^2$, $R^3$, $R^4$ and $R^f$ are as hereinbefore defined. Especially preferred dyes of Formula (12D) are those in which $R^f$ is —$SCH_3$, $R^1$ is straight or branched chain $C_{1-8}$-alkyl, $R^2$ and $R^3$ are both —$CH_3$ and $R^4$ is —H.

A further preferred sub group of dyes of Formula (1) are those of Formula (13):

Formula (13)

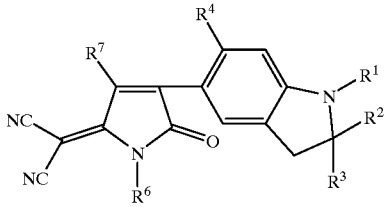

in which $R^1$, $R^2$, $R^3$ and $R^4$ are as hereinbefore defined;

$R^6$ is —H, $C_{1-8}$-alkyl or —$CH_2$phenyl; and $R^7$ is —CN or —$COOC_{1-8}$-alkyl.

Preferred dyes of Formula (13) are those in which $R^1$ is n-pentyl, n-hexyl, n-heptyl or isobutyl, $R^2$ and $R^3$ are both methyl, $R^4$ is —H, —$CH_3$ or —$NHCOCH_3$, $R^6$ is —H and $R^7$ is —CN. Especially preferred dyes of Formula (13) are those in which $R^1$ is n-heptyl or isobutyl, $R^2$ and $R^3$ are both methyl, $R^4$ is —H, —$CH_3$ or —$NHCOCH_3$, $R^6$ is —H and $R^7$ is —CN.

A further preferred sub group of dyes of Formula (1) are those of Formula (14):

Formula (14)

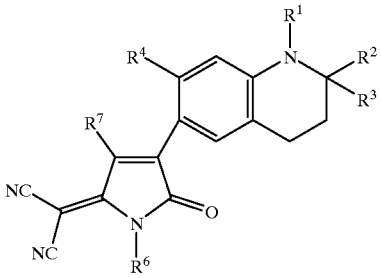

in which $R^1$, $R^2$, $R^3$ and $R^4$ are as hereinbefore defined, $R^6$ is —H, $C_{1-8}$-alkyl or —$CH_2$phenyl; and $R^7$ is —CN or —$COOC_{1-8}$-alkyl.

A further preferred subgroup of dyes of Formula (1) are those of Formula (15):

Formula (15)

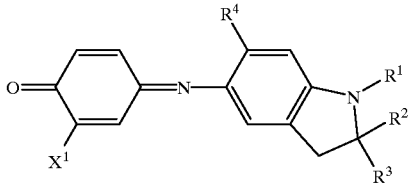

in which $R^1$, $R^2$, $R^3$ and $R^4$ are as hereinbefore defined; and $X^1$ is —H, $C_{1-8}$-alkyl, —$NHCOC_{1-8}$-alkyl or —$CONHC_{1-8}$-alkyl.

The present dyes may be used alone for example to give magenta, yellow or cyan shades or other shades on the thermal transfer sheet and on the receiver sheet or the dyes may be used in combination with each other or with other dyes to produce intermediates shades or black mixtures.

The dyes of Formula (1) may be prepared by reacting a compound of Formula (16):

Formula (16)

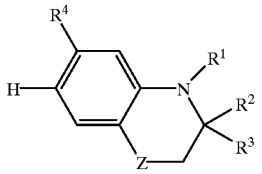

with a compound of Formula A-X. Where A is a group of Formula (2) X is a diazonium salt prepared by diazotisation, using conventional reaction conditions, of the corresponding amine, A—$NH_2$.

Where A is a group of Formula (3) X is halogen preferably —Cl or —Br and the reaction may be performed in a liquid medium such as N, N-dimethylformamide or N, N-dimethylacetamide at a temperature from −20° C. to 50° C. The product may be isolated by any convenient means such as pouring the reaction product into water and recovering the precipitated product by filtration.

Dyes of Formula (1) in which A is a group of Formula (4) may be prepared by oxidative coupling of a phenol with a compound of Formula (1) in which A is —$NH_2$ using an oxidising agent such as an alkali metal persulphate, alternatively by nitrosation of a compound of Formula (1) in which A is H and reaction with a phenol in the presence of acetic anhydride.

Dyes of Formula (1) in which A is a group of Formula (5) may be prepared by reaction of a compound of Formula (1) in which A is —CHO or —NO with a compound of Formula (5B):

Formula (5B)

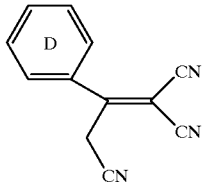

in the presence of catalytic amounts of an organic base such as piperdine.

The compound of Formula (5B) may be obtained by reaction of malononitrile with benzoylacetonitrile.

Dyes of Formula (1) in which A is a group of Formula (6) and $R^{13}$ is H may be prepared by condensation of a compound of Formula (1) in which A is —CHO with an active methylene compound such as malonitrile or an alkylcyanoacetate such as ethylcyanoacetate.

Dyes of Formula (1) in which A is a group of Formula (6) and $R^{13}$ is —CN may be prepared by reaction of a compound of Formula (1) in which A is —H with tetracyanoethylene in an organic liquid such as dimethylformanide.

Dyes of Formula (1) in which A is a group of Formula (7) may be prepared by reaction of a compound of Formula (1) where A is —CHO with a diaryldiketopyrrole.

Dyes of Formula (1) in which A is a group of Formula (8) may be prepared by reacting a compound of Formula (1) where A is —$NH_2$ or —NO with a compound of Formula (8B):

Formula (8B)

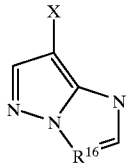

where X is a displaceable atom or group such as —H or —Cl.

Dyes of Formula (1) in which A is a group of Formula (9) may be prepared by coupling a compound of Formula (1) in which A is —H with a diazotised compound of Formula (9B):

Formula (9B)

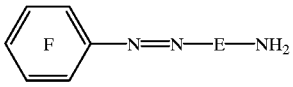

Dyes of Formula (1) in which A is a group of Formula (10) may be prepared by reacting a compound of Formula (10B):

(Formula 10B)

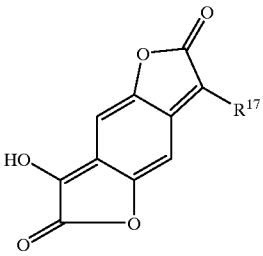

with a compound of Formula (16) in an acid medium

The compound of Formula (16) may be prepared by reacting an indoline or piperazine of Formula (16) in which $R^1$ is —H with a compound of Formula $R^1$—Y in which Y is a halogen such as —Cl, —Br or I or a tosylate or mesylate in the presence of an alkali or alkaline earth metal carbonate. Alternatively the compound of Formula (16) in which Z is a direct link may be prepared by reaction of an aniline firstly with a compound $R^1$—Y to replace one of the —H atoms attached to the N atom followed by reaction with a haloalkene such as 3-chloro-2-methylpropene in the presence of a base such as NaH or $K_2CO_3$ in a liquid medium such as dimethylformamide or tetrahydrofuran to form an N-alkyleneaminobenzene followed by ring closure by heating at about 140° C. in a liquid medium such as xylene in the presence of a Lewis acid such as $ZnCl_2$ or a protic acid such as $H_3PO_4$ or $H_2SO_4$.

Compared with open chain analogues introduction of such a group generally improves the properties of dyes such as improving light fastness properties and induces into a dye molecule a bathochromic shift in the λ max. value of the dye for example a typical shift of approximately 20–30 nm is obtained in dyes in which A is a group of Formula (3) and has the advantage of allowing shade changes to be conveniently obtained.

The Coating

The coating suitably comprises a binder together with a dye or mixture of dyes of Formula (1). The ratio of binder to dye is preferably at least 0.7:1 and more preferably from 1:1 to 4:1 and especially preferably 1:1 to 2:1 in order to provide good adhesion between the dye and the substrate and inhibit migration of the dye during storage.

The coating may also contain other additives, such as curing agents, preservatives, etc., these and other ingredients being described more fully in EP 133011A, EP 133012A and EP 111004A.

The Binder

The binder may be any resinous or polymeric material suitable for binding the dye to the substrate which has acceptable solubility in the ink medium, i.e. the medium in which the dye and binder are applied to the transfer sheet. It is preferred however, that the dye is soluble in the binder so that it can exist as a solid solution in the binder on the transfer sheet. In this form it is generally more resistant to migration and crystallisation during storage. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral, polyvinyl acetoacetal and polyvinyl pyrrolidone; polycarbonates such as AL-71 from Mitsubishi Gas Chemicals and MAKROLON 2040 from Bayer (MAKROLON is a trade mark); polymers and co-polymers derived from acrylates and acrylate derivatives, such as polyacrylic acid, polymethyl methacrylate and styrene-acrylate copolymers, styrene derivatives such as polystyrene, polyester resins, polyamide resins, such as melamines; polyurea and polyurethane resins; organosilicones, such as polysiloxanes, epoxy resins and natural resins, such as gum tragacanth and gum arabic. Mixtures of two or more of the above resins may also be used, mixtures preferably comprise a vinyl resin or derivative and a cellulose derivative, more preferably the mixture comprises polyvinyl butyral and ethylcellulose. It is also preferred to use a binder or mixture of binders which is soluble in one of the above-mentioned commercially acceptable organic solvents.

The dye or mixture of dyes of Formula (1) has good thermal properties giving rise to even prints on the receiver sheet, whose depth of shade is accurately proportional to the quantity of applied heat so that a true grey scale of coloration can be attained.

The dye or mixture of dyes of Formula (1) also has strong absorbance properties and is soluble in a wide range of solvents, especially those solvents which are widely used and accepted in the printing industry, for example, alkanols, such as i-propanol and butanol; aromatic hydrocarbons, such as toluene, ethers, such as tetrahydrofuran and ketones such as MEK, MIBK and cyclohexanone. Alternatively the mixture of dyes may be dispersed by high shear mixing in suitable media such as water, in the presence of dispersing agents. This produces inks (solvent plus mixture of dyes and binder) which are stable and allow production of solution or dispersion coated dyesheets. The latter are stable, being resistant to dye crystallisation or migration during prolonged storage.

The combination of strong absorbance properties and good solubility in the preferred solvents allows the achievement of good OD of the dye or mixture of dyes of Formula (1) on the receiver sheet. The transfer sheets of the present invention have good stability and produce receiver sheets with good OD and which are fast to both light and heat.

The Substrate

The substrate may be any sheet material preferably having at least one smooth even surface and capable of withstanding the temperatures involved in DDTTP, i.e. up to 400° C. for periods up to 20 msec, yet thin enough to transmit heat applied on one side through to the dyes on the other side to effect transfer of the dye onto a receiver sheet within such short periods. Examples of suitable materials are polymers, especially polyester, polyacrylate, polyamide, cellulosic and polyalkylene films, metallised forms thereof, including co-polymer and laminated films, especially laminates incorporating a smooth even polyester receptor layer on which the dye is deposited. Thin (<20 micron) high quality paper of even thickness and having a smooth coated surface, such as capacitor paper, is also suitable. A laminated substrate preferably comprises a backcoat, on the opposite side of the laminate from the receptor layer, which, in the printing process, holds the molten mass together, such as a thermosetting resin, e.g a silicone, acrylate or polyurethane resin, to separate the heat source from the polyester and prevent melting of the latter during the DDTTP operation. The thickness of the substrate depends to some extent upon its thermal conductivity but it is preferably less than 20 $\mu$m and more preferably less than 10 $\mu$m.

The DDTTP Process

According to a further feature of the present invention there is provided a dye diffusion thermal transfer printing process which comprises contacting a transfer sheet comprising a coating comprising a dye or mixture of dyes of Formula (1) with a receiver sheet, so that the coating is in contact with the receiver sheet and selectively applying heat to discrete areas on the reverse side of the transfer sheet whereby the dye on the opposite side of the sheet to the heated areas is transferred to the receiver sheet.

Heating in the selected areas may be effected by contact with heating elements, which can be heated to 200–450° C., preferably 200–400° C., over periods of 2 to 10 msec, whereby the dye mixture may be heated to 150–300° C., depending on the time of exposure, and thereby caused to transfer, substantially by diffusion, from the transfer to the receiver sheet. Good contact between coating and receiver sheet at the point of application is essential to effect transfer. The density of the printed image is related to the time period for which the transfer sheet is heated.

The Receiver Sheet

The receiver sheet conveniently comprises a polyester sheet material, especially a white polyester film, preferably of polyethylene terephthalate (PET). Although some dyes of Formula (1) are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye is applied, into which the dye mixture more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the dyes of Formula (1) give particularly strong and good quality prints (e.g. fastness and storage properties) on any specific transfer or receiver sheet. The design of receiver and transfer sheets is discussed further in EP 133,011 and EP 133012.

The invention is further illustrated by the following examples and comparative examples in which all parts and percentages are by weight.

Ink Preparation

The inks were prepared by dissolving 0.15 g of the dye in a solution containing 5 g of a 6% w/w solution of ethylhydroxyethyl cellulose (EHEC) in tetrahydrofuran and 4.85 g tetrahydrofuran (THF).

Transfer Sheet TS1

This was prepared by applying Ink 1 to a 6 μm polyester film (substrate) using a wire-wound metal Meyer-bar (K-bar No 3) to produce a wet film of ink on the surface of the sheet. The ink was then dried with hot air to give a dry film on the surface of the substrate.

Printed Receiver Sheet RS1

A sample of TS1 was contacted with a receiver sheet, comprising a composite structure based in a white polyester base having a receptive coating layer on the side in contact with the printed surface of TS1. The receiver and transfer sheets were placed together on the drum of a transfer printing machine and passed over a matrix of closely-spaced elements which were selectively heated using a constant power of 0.37 W/pixel for periods from 2 to 10 msec, whereby a quantity of the dye, in proportion to the heating period, at the position on the transfer sheet in contact with an element while it was hot was transferred from the transfer sheet to the receiver sheet. After passage over the array of elements the transfer sheet was separated from the receiver sheet.

Evaluation of Inks, Transfer Sheets and Printed Receiver Sheets

The stability of the ink was assessed by visual inspection. An ink was considered to be stable if there was no precipitation over a period of two weeks at ambient.

The invention is illustrated by the following examples:

EXAMPLE 1

Preparation of:

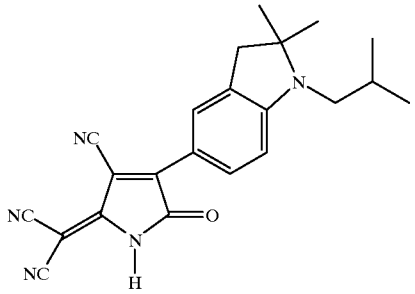

i) A mixture of N-(2-methylprop-2-en-3-yl)-N-isobutylaniline (6.1 g) and zinc chloride (3.9 g) in m-xylene (50 $cm^3$) was heated under reflux for 24 hours before dissolving in dichloromethane and filtering. The dichloromethane solution was washed with water, separated and dried over anhydrous magnesium sulphate. The magnesium sulphate was removed by filtration and the dichloromethane was separated to leave a crude oil which was purified by elution from silica with a 9:1 mixture of hexane:dichloromethane. The solvent was evaporated to leave 2,2-dimethyl N-isobutylindoline (4.3 g, 71.4%) as a colourless oil.

ii) 2,2-dimethyl N-isobutylindoline (1.2 g), (1.32 g), acetic anhydride (0.5 $cm^3$) and dimethylformamide (25 $cm^3$) were mixed and cooled to −1° C. Phosphorus oxychloride (5.0 g) was added dropwise stirring the reaction mixture at 0° C. for 1 hour. The reaction mixture was allowed to warm to ambient temperature before pouring into ice and isolating the precipitate by filtration.

The solid obtained was dried under vacuum at 60° C. to yield the title compound (1.5 g, 70%) m.p.t. 278–280° C.

EXAMPLE 2

Preparation of:

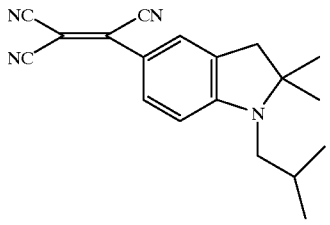

2,2-Dimethyl N-isobutylindoline (1.01 g) and tetracyanoethylene (0.64 g) in dimethylformamide (6 $cm^3$) was heated at 60° C. for 10 minutes before cooling in ice and adding water. The aqueous mixture was extracted with dichloromethane, the dichloromethane was dried over magnesium sulphate, filtered and evaporated to give the title compound (1.07 g, 70.4%), m.p.t. 156–157° C., λmax=546 nm, m/Z=304.

EXAMPLE 3

Preparation of:

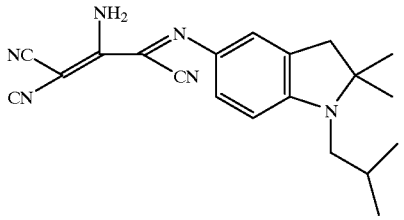

i) A mixture of 2,2-dimethyl N-isobutylindoline (2.0 g) and concentrated hydrochloric acid (4.5 $cm^3$) was cooled to 8° C. and sodium nitrite (0.8 g) in water (2 $cm^3$) was added dropwise. The reaction mixture was allowed to warm to ambient temperature, made alkaline with sodium hydroxide solution an extracted with ethyl acetate. The ethyl acetate was dried over magnesium sulphate, filtered and evaporated to give 5-nitroso-2,2-dimethyl N-isobutyl indoline.

ii) 5-nitroso-2,2-dimethyl N-isobutyl indoline from i), 2-amino-1,1,3-tricyanoprop-2-ene (0.66 g) methylated spirits (50 $cm^3$) and sodium hydroxide solution (10%, 2 drops) were heated under reflux for 1 hour before cooling and evaporating the solvent. The residue was eluted from silica using 50:(dichloromethane) methanol as eluent. Evaporation of the solvent gave the title compound m.p. 173–175° C., λmax=560 nm, m/Z=346.

EXAMPLE 4

Preparation of:

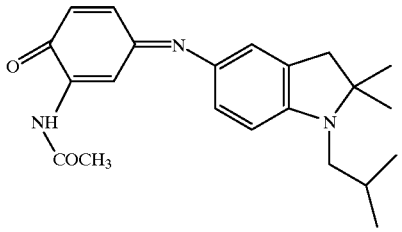

5-Nitroso-2,2-dimethyl N-isobutyl indoline (1.16 g), 2-acetamidophenol (0.76 g), acetic anhydride (1 $cm^3$) and methylated spirits (50 $cm^3$) was stirred at room temperature for three days before filtering. The filtrated were evaporated to leave a residue which was eluted from silica using 50:50 ethylacetate/hexane as eluent. Evaporation of the solvent gave the title compound λmax=649 nm, m/Z=365.

EXAMPLE 5

Preparation of:

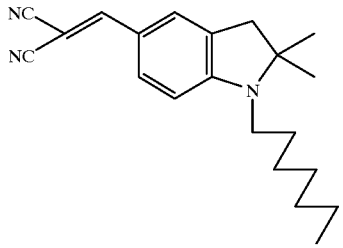

i) N-(2-methylprop-2-en-3-yl)N-n-heptyl aniline (0.38 mole), zinc chloride (0.4 mole) and m-xylene (200 $cm^3$) were refluxed for 17 hours before cooling and dissolving in dichloromethane. The dichloromethane was filtered and washed with water, separated, dried over magnesium sulphate, filtered and evaporated to leave an oil. The oil was eluted from silica using 50:50 dichloromethane/hexane as eluent evaporated of the solvent gave 2,2-dimethyl-N-n-heptylindoline (122 g, 95.8%).

ii) To 2,2-dimethyl-N-n-heptylindoline (12.5 g) in dimethylformamide (100 $cm^3$) phosphorus oxychloride (15.3 g) was added at 5° C. before heating the mixture at 80° C. for 2–5 hours. The reaction mixture was cooled, poured onto ice, neutralised with solid sodium carbonate and extracted into toluene. The toluene was washed with water, separated, dried over magnesium sulphate, filtered and evaporated to leave an oil. The oil was eluted from silica using dichloromethane as eluent, evaporation of the solvent gave 2,2-dimethyl-5-formyl-N-n-heptylindoline (4.9 g, 36.1%).

iii) 2,2-dimethyl-5-formyl-N-n-heptylindoline (1.1 g), malononitrile (0.27 g), methylated spirits (20 $cm^3$) and piperdine (2 drops) was stirred at room temperature for 2 days. The solvent was evaporated and the residue eluted from silica using dichloromethane as eluent. Evaporation of the dichloromethane gave the title compound (0.9 g, 69.6%), λmax=454 nm, m/Z=321.

EXAMPLE 6

Preparation of:

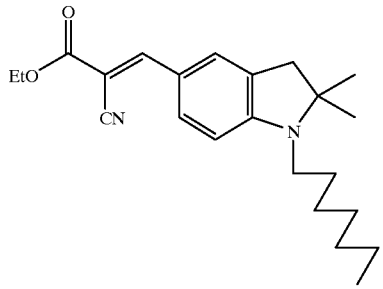

2,2-dimethyl-5-formyl-N-n-heptylindoline (1.1 g), ethylcyanoacetate (0.46 g), methylated spirits (10 $cm^3$) and piperidine (2 drops) were stirred at room temperature for 1 day before evaporating the solvent to leave an oil. The oil was eluted from silica using dichloromethane as eluent. Evaporation of the solvent gave the title compound λmax=444 nm, m/Z=368.

EXAMPLE 7

Preparation of:

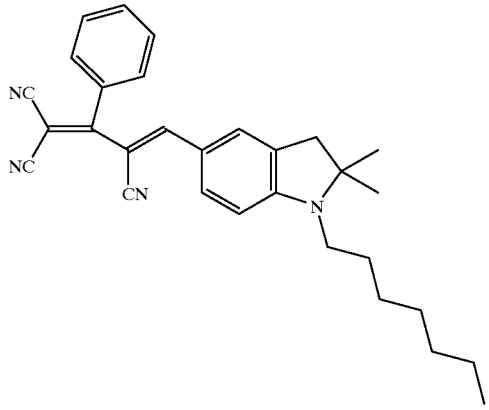

2,2-dimethyl-5-formyl-N-n-heptylindoline (1.1 g), 2-phenyl-1,1,3-tricyanoprop-2-ene (0.78 g), methylated spirits (20 $cm^3$ ) and piperdine (2 drops) were stirred at room temperature for 5 hours before evaporating the solvent to leave a residue which was eluted from silica using 80:20 hexane/ethylacetate as eluent. Evaporation of the solvent gave the title compound (1.5 g, 83.1%) λmax=548 nm, m/Z=448.

EXAMPLE 8

Preparation of:

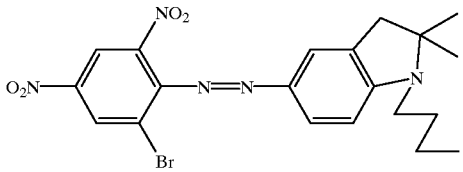

Acetic acid (60 $cm^3$), propionic acid (11 $cm^3$) and sulphuric acid (3 $cm^3$) were mixed and cooled to less than 5° C. before adding nitrosylsulphuric acid (9.3 $cm^3$) at less than 5° C. After stirring for 15 minutes 2-bromo-4,6-dinitroaniline (3.51 g) was added and the mixture was stirred for 1.5 hours at less than 5° C.

2,2-dimethyl N-n-butylindoline (2.0 g) was dissolved in methanol (100 $cm^3$) and cooled to less than 5° C. and the diazo solution added slowly at 5° C. After 1 hour sodium acetate was added to adjust the pH to 4. The mixture was filtered and the separated solid washed with water. The solid was dissolved in acetone, dried over magnesium sulphate, filtered and evaporated to give the title compound (1.26 g, 26.5%) λmax=582 nm.

Examples 9 to 20 were prepared using the method of Example 8, these examples are summarised in Table 1.

TABLE 1

| Example | Dye | Analytical Data |
|---|---|---|
| 9 | 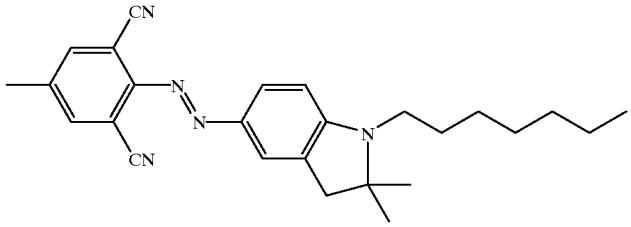 | m/Z = 413<br>λ max = 524 nm |
| 10 | 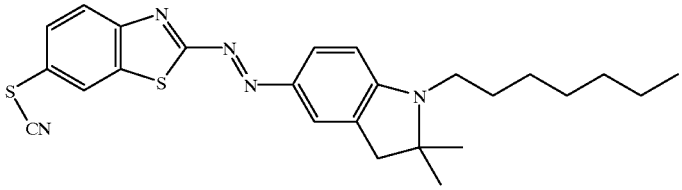 | m/Z = 463<br>λ max = 548 nm |
| 11 | 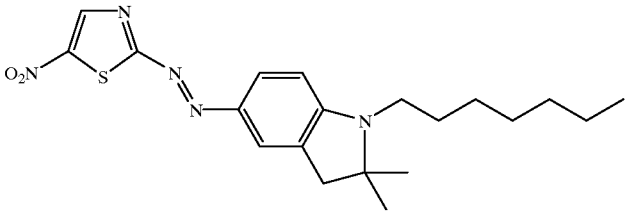 | m/Z = 401<br>λ max = 616 nm |
| 12 | 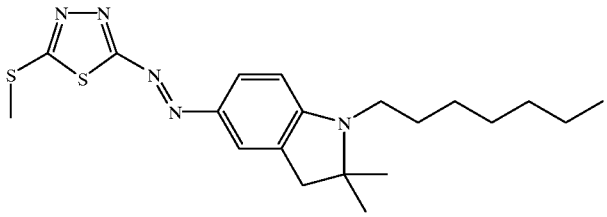 | m/Z = 403<br>λ max = 528 nm |
| 13 | 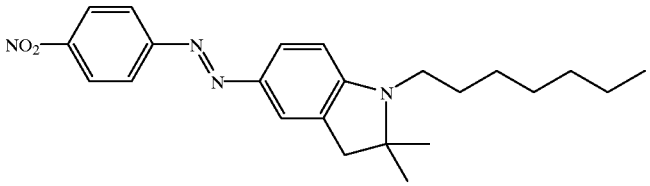 | m/Z = 394<br>λ max = 522 nm |

TABLE 1-continued
| Example | Dye | Analytical Data |
|---|---|---|
| 14 | 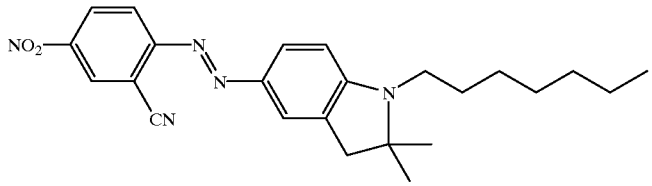 | m/Z = 419<br>λ max = 574 nm |
| 15 | 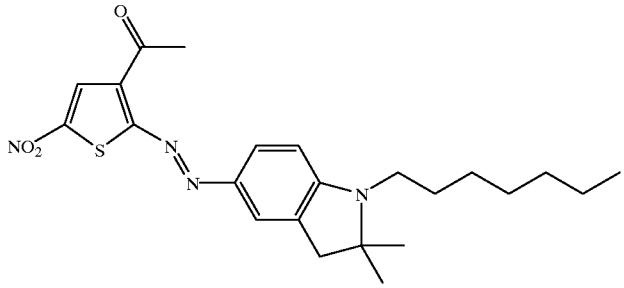 | m/Z = 442<br>λ max = 632 nm |
| 16 | 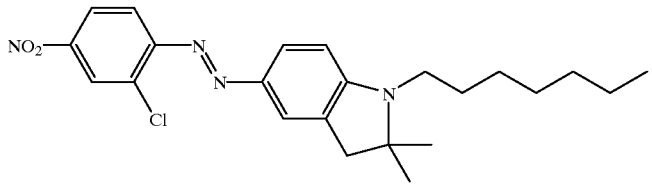 | m/Z = 438<br>λ max = 544 nm |
| 17 | 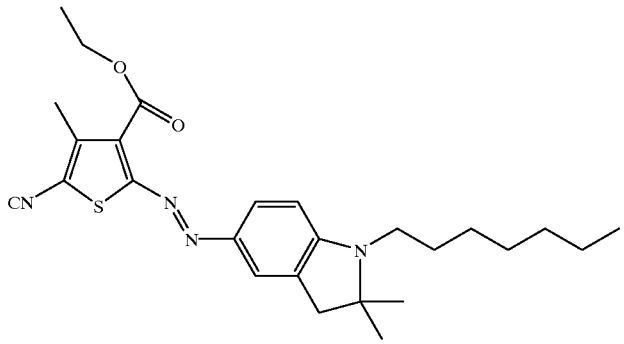 | m/Z = 466<br>λ max = 562 nm |
| 18 | 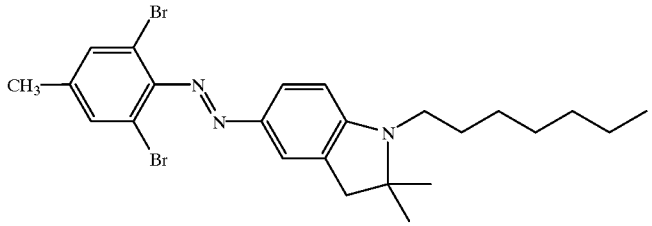 | m/Z = 519<br>λ max = 424 nm |

TABLE 1-continued

| Example | Dye | Analytical Data |
|---|---|---|
| 19 | 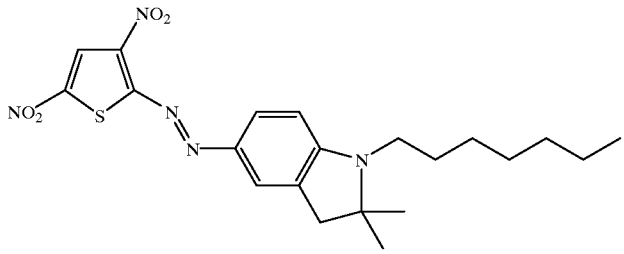 | m/Z = 445<br>λ max = 676 nm |
| 20 | 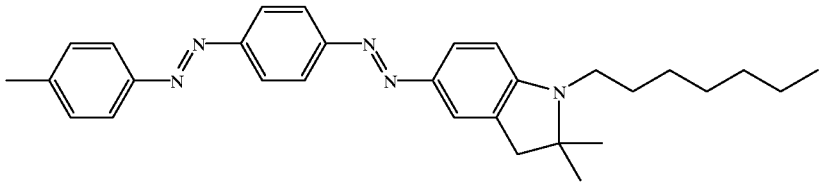 | m/Z = 467<br>λ max = 510 nm |

EXAMPLE 21

Preparation of:

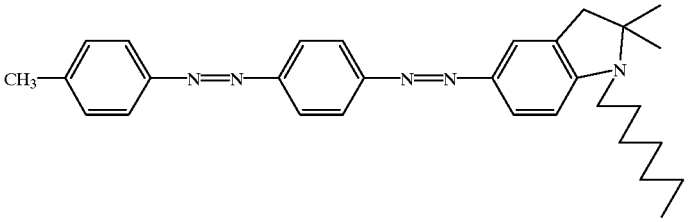

A mixture of 4-(4-methylphenylazo) aniline (1.6 g), acetic acid (43 $cm^3$), propionic acid (7 $cm^3$) was cooled to less than 10° C. and nitrosyl sulphuric acid (3.0 $cm^3$) was added, the mixture was stirred at 5° C. for 45 minutes before adding to a mixture of 2,2-dimethyl N-n-heptylindoline (2.0 g) in acetic acid (50 $cm^3$). The reaction mixture was poured into ice/water and sodium acetate was added. The reaction mixture was extracted into ethyl acetate evaporation of which gave the title compound (1.08 g). λmax=510 nm, m/Z=467.

EXAMPLE 22

Preparation of:

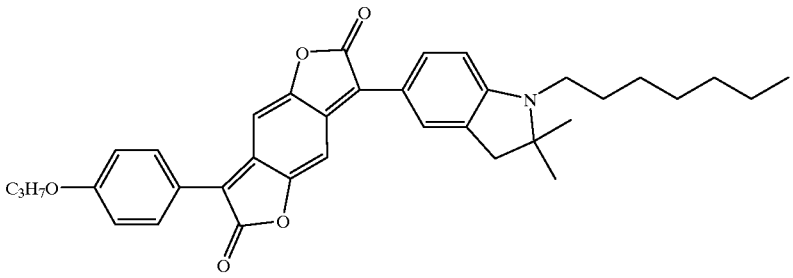

A mixture of 3-hydroxy-7-(4-n-propoxyphenyl)-2,6-dioxo-2,6-dihydrobenzo-[1:2-b,4:5-b']-difuran (0.7 g), acetic acid (23.8 $cm^3$), sulphuric acid (1.2 $cm^3$) and 2,2-dimethyl-N-n-heptylindoline (0.6 g) was heated at 140° C. for 12 hours before pouring into a mixture of ice and water to precipitate a solid which was isolated by filtration. The solid was eluted from silica using dichloromethane as eluent evaporation gave the title compound (0.48 g) λmax=702 nm, m/Z=565.

EXAMPLE 23

Preparation of:

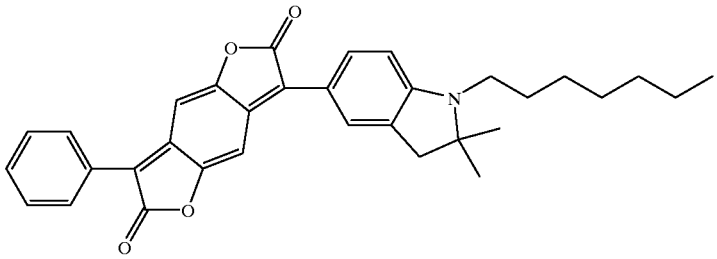

A mixture of 7-phenyl-7-H-benzodifuran-2,3,6-trione (1.4 g), acetic acid (47.5 $cm^3$), sulphuric acid (2.5 $cm^3$) and 2,2-dimethyl-N-n-heptylindoline (1.25 g) was stirred at 140° C. for 10 hours before pouring into ice/water. The precipitated solid was isolated by filtration and purified as in Example 21 to give the title compound (0.76 g) λmax=712 nm, m/Z=507.

EXAMPLE 24

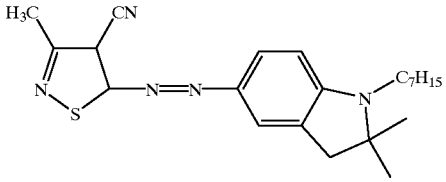

was prepared using the method of Example 8.

EXAMPLE 25

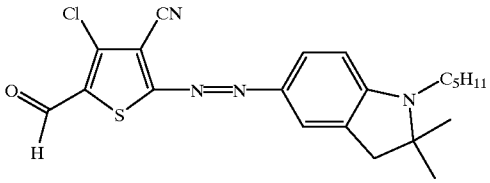

The indoline coupler was prepared as described in Example i) using N-(2-methylprop-2-en-3yl)-N-n-pentylaniline in place of the N-(2-methylprop-2-en-3-yl)-N-isobutylaniline.

The dye was prepared as described in Example 8 using 2-amino-4-chloro-3-cyano-5-formylthiophene in place of the 2-bromo-4,6-dinitroaniline.

EXAMPLE 26

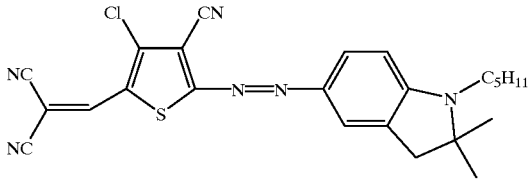

The dye was prepared by reacting the dye of Example 25 with malononitrile.

EXAMPLE 27

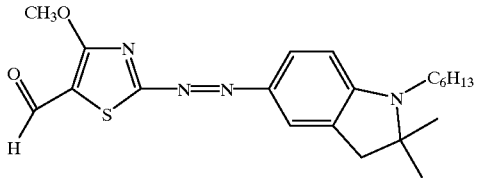

The indoline coupler was prepared as described in Example 1 i) using N-(2-methylprop-2-en-3-yl)-N-n-hexylaniline in place of the N-(2-methylprop-2-en-3-yl)-N-isobutylaniline.

The dye was prepared as described in Example 8 using 2-amino-4-chloro-5-formylthiophene in place of the 2-bromo-4,6-dinitroaniline followed by reaction with sodium methoxide.

EXAMPLE 28

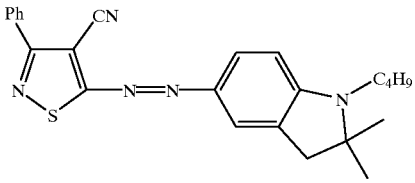

The indoline coupler was prepared as described in Example 1 i) using N-(2-methylprop-2-en-3-yl)-N-n-butylaniline in place of the N-(2-methylprop-2-en-3-yl)-N-isobutylaniline.

The dye was prepared as described in Example 8 using 5-amino-4-cyano-3-phenylisothiazole in place of the 2-bromo-4,6-dinitroaniline.

EXAMPLE 29

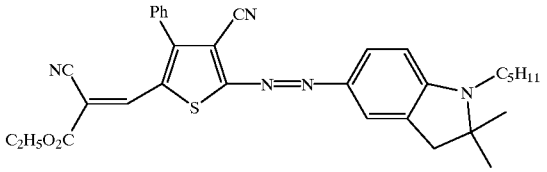

The dye was prepared by reacting the dye of Example 25 with ethylcyanoacetate.

EXAMPLE 30

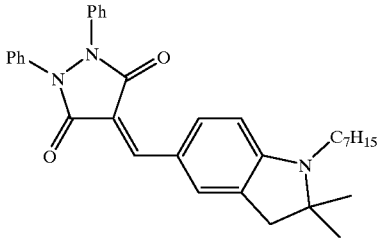

The dye was prepared as described in Example 5 except that 1,2-diphenyl-3,5-diketopyrole was used in phase of the malonitrile.

EXAMPLE 31

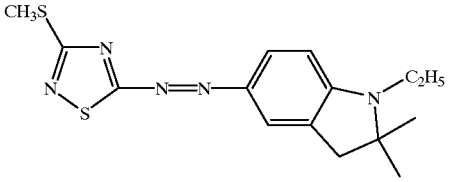

The coupler was prepared as described in Example 1 i) using N-(2-methylprop-2-en-3-yl) N-ethylaniline in place of the N-(2-methylprop-2-en3-yl)-N-isobutylaniline.

The dye was prepared as described in Example 8 using 5-amino-3-methylthio-1,2,4-thiadiazole in place of the 2-bromo-4,6-dinitroaniline.

EXAMPLE 32

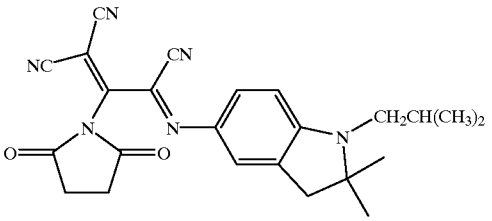

The dye was prepared by reacting the dye of Example 3 with succanic anhydride.

In addition to the use described above in D2T2 printing the present dyes of Formula (1) are useful as colorants for a variety of applications particularly in inks for use in ink jet printing, as toners for use in reprography and as dyes for dyeing and printing textile materials such as polyester and blends thereof.

The dyes of Formula (1) used to prepare inks and transfer sheets and for printing on receiver sheets are shown in Table 2 along with their OD values. The OD values for the dyes of Examples 2, 5, 7 and 8 were measured using a Sakura Digital Densitometer. The OD values of the dyes of Examples 9, 11 to 14, 16, 17, 20, 24 were measured on an X-RITE spectrodensitometer.

TABLE 2

| Example | OD |
|---|---|
| 2 | 2.7 |
| 5 | 1.74 |
| 7 | 2.5 |
| 8 | 1.7 |
| 9 | 2.94 |
| 11 | 3.4 |
| 12 | 3.29 |
| 13 | 2.58 |
| 14 | 2.95 |
| 16 | 2.38 |
| 17 | 2.37 |
| 19 | 3.61 |
| 20 | 1.96 |
| 24 | 3.4 |

What is claimed is:

1. A dye diffusion thermal transfer printing process comprising contacting a transfer sheet comprising a coating comprising a binder and a dye or mixture of dyes of Formula (1)

Formula (1)

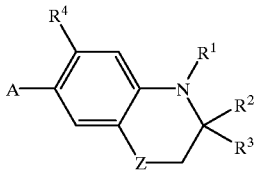

wherein $R^1$ is alkyl, cycloalkyl, aryl, alkenyl or aralkyl each of which may be optionally substituted;

$R^2$ and $R^3$ each independently is an optionally substituted alkyl;

$R^4$ is —H, —OH or alkyl, alkoxy, —NHCOalkyl, —NHCOaryl, —$NHSO_2$alkyl, —$NHSO_2$aryl each of which may be optionally substituted;

Z is a direct link, oxygen or —N—$R^5$ in which $R^5$ is —H, optionally substituted alkyl or optionally substituted aryl;

A is a group of Formula (2):

B—N=N— Formula (2)

in which B is an isothiazolyl group which may be optionally substituted with a member of the group consisting of —$NO_2$, —CN, —OH, —Cl, —F, —Br, —SCN, phenyl, alkyl, alkoxy, alkylthio, alkoxyalkoxy, alkylcarbonyl, alkoxycarbonyl, alkylalkoxycarbonyl, alkoxyalkoxycarbonyl, alkoxycarbonyloxy, phenoxylalkyl, phenylalkyl, alkylcarbonyloxy, alkoxyalkoxycarbonyloxy, phenoxylalkoxycarbonyl, —$NR^8R^9$, —$COR^8$, —$CO_2R^8$, in which $R^8$ and $R^9$ are each independently H or any of the groups given for $R^1$, —NHCOalkyl and —$NHSO_2$alkyl;

with a receiver sheet and selectively applying heat to discrete areas on the reverse side of the transfer sheet whereby the dye on the opposite side of the sheet to the heated areas is transferred to the receiver sheet.

2. A thermal transfer sheet comprising a substrate having a coating comprising a binder and a dye of Formula Formula (1)

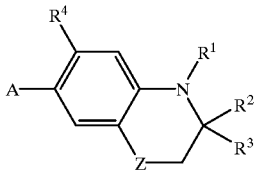

in which $R^1$ is alkyl, cycloalkyl, aryl, alkenyl or aralkyl each of which may be optionally substituted;

$R^2$ and $R^3$ each independently is optionally substituted alkyl;

$R^4$ is —H, —OH or alkyl, alkoxy, —NHCOalkyl, —NHCOaryl, —$NHSO_2$alkyl, —$NHSO_2$aryl each of which may be optionally substituted;

Z is a direct link, oxygen or —N—$R^5$ in which $R^5$ is —H, optionally substituted alkyl or optionally substituted aryl;

A is a group of Formula (2):

B—N=N— Formula (2)

in which B is an isothiazolyl group which may be optionally substituted with a member of the group consisting of —$NO_2$, —CN, —OH, —Cl, —F, —Br, —SCN, phenyl, alkyl, alkoxy, alkylthio, alkoxyalkoxy, alkylcarbonyl, alkoxycarbonyl, alkylalkoxycarbonyl, alkoxyalkoxycarbonyl, alkoxycarbonyloxy, phenoxylalkyl, phenylalkyl, alkylcarbonyloxy, alkoxyalkoxycarbonyloxy, phenoxylalkoxycarbonyl, —$NR^8R^9$, —$COR^8$, —$CO_2R^8$, in which $R^8$ and $R^9$ are each independently H or any of the groups given for $R^1$, —NHCOalkyl and —$NHSO_2$alkyl.

3. A thermal transfer sheet comprising a substrate having a coating comprising a binder and a dye of Formula (12)

Formula (12)

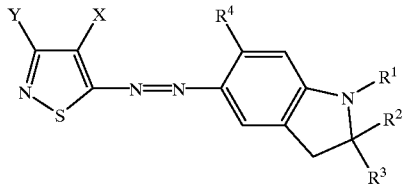

in which $R^1$ is alkyl, cycloalkyl, aryl, alkenyl or aralkyl each of which may be optionally substituted;

$R^2$ and $R^3$ each independently is optionally substituted alkyl;

$R^4$ is —H, —OH or alkyl, alkoxy, —NHCOalkyl, —NHCOaryl, —$NHSO_2$alkyl, —$NHSO_2$aryl each of which may be optionally substituted;

X is —CN or halogen; and

Y is pyridyl, aryl or $C_{1-8}$-alkyl optionally substituted by $C_{1-4}$-alkoxy.

4. A dye diffusion thermal transfer printing process comprising contacting a transfer sheet comprising a coating comprising a binder and a dye or mixture of dyes of Formula (1)

Formula (1)

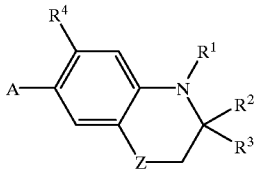

wherein $R^1$ is alkyl, cycloalkyl, aryl, alkenyl or aralkyl each of which may be optionally substituted;

$R^2$ and $R^3$ each independently is an optionally substituted alkyl;

$R^4$ is —H, —OH or alkyl, alkoxy, —NHCOalkyl, —NHCOaryl, —$NHSO_2$alkyl, —$NHSO_2$aryl each of which may be optionally substituted;

Z is a direct link; and

A is a group of Formula (2):

B—N=N— Formula (2)

in which B is an isothiazolyl which may be optionally substituted; with a receiver sheet and selectively applying heat to discrete areas on the reverse side of the transfer sheet whereby the dye on the opposite side of the sheet to the heated areas is transferred to the receiver sheet.

5. A thermal transfer sheet comprising a substrate having a coating comprising a binder and a dye of Formula (1):

Formula (1)

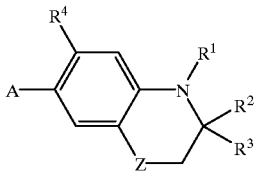

in which $R^1$ is alkyl, cycloalkyl, aryl, alkenyl or aralkyl each of which may be optionally substituted;

$R^2$ and $R^3$ each independently is optionally substituted alkyl;

$R^4$ is —H, —OH or alkyl, alkoxy, —NHCOalkyl, —NHCOaryl, —$NHSO_2$alkyl, —$NHSO_2$aryl each of which may be optionally substituted;

Z is a direct link; and

A is a group of Formula (2):

B—N=N— Formula (2)

in which B is an isothiazolyl group which may be optionally substituted.

* * * * *